US009531122B2

(12) United States Patent
Iida

(10) Patent No.: US 9,531,122 B2
(45) Date of Patent: Dec. 27, 2016

(54) CONNECTOR

(71) Applicant: Molex, LLC, Lisle, IL (US)

(72) Inventor: Takashi Iida, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/913,651

(22) PCT Filed: Aug. 27, 2014

(86) PCT No.: PCT/IB2014/002921
§ 371 (c)(1),
(2) Date: Feb. 22, 2016

(87) PCT Pub. No.: WO2015/052589
PCT Pub. Date: Apr. 16, 2015

(65) Prior Publication Data

US 2016/0204547 A1 Jul. 14, 2016

(30) Foreign Application Priority Data

Aug. 28, 2013 (JP) ..... 2013-176360

(51) Int. Cl.

| | |
|---|---|
| ***H01R 13/62*** | (2006.01) |
| ***H01R 13/627*** | (2006.01) |
| ***H01R 13/516*** | (2006.01) |
| *H01R 13/506* | (2006.01) |
| *H01R 24/20* | (2011.01) |
| *H01R 107/00* | (2006.01) |

(52) U.S. Cl.
CPC ..... *H01R 13/6272* (2013.01); *H01R 13/516* (2013.01); *H01R 13/6271* (2013.01); *H01R 13/506* (2013.01); *H01R 24/20* (2013.01); *H01R 2107/00* (2013.01)

(58) Field of Classification Search
CPC .. H01R 13/6272; H01R 13/516; H01R 13/518
See application file for complete search history.

(56) References Cited

U.S. PATENT DOCUMENTS

| | | | | |
|---|---|---|---|---|
| 1,975,244 A * | 10/1934 | Wiseman | F16B 7/22 16/DIG. 41 |
| 4,114,970 A * | 9/1978 | Hall, Jr. | H01R 13/523 439/294 |
| 4,204,188 A * | 5/1980 | Weichart | G01V 1/201 174/101.5 |
| 5,180,316 A | 1/1993 | Miller | |

(Continued)

FOREIGN PATENT DOCUMENTS

| | | |
|---|---|---|
| JP | 2002-301987 A | 10/2002 |
| JP | 2013-067197 A | 4/2013 |

*Primary Examiner* — Ross Gushi
(74) *Attorney, Agent, or Firm* — Clarence R. Moon

(57) ABSTRACT

The connector of the present invention includes a case 2 receiving passed through cables 9 and passed through a cylindrical member 8, a side surface of the case when aligned axially with the direction of insertion into the cylindrical member 8 having an outer peripheral surface portion 21 with a shape corresponding to the inner peripheral surface 81 of the cylindrical member 8, and an engaging surface portion 23 having an engaging piece 35 for engaging another connector and forming a space S for arranging the cables 9 between the engaging surface and the inner peripheral surface 81 of the cylindrical member 8.

5 Claims, 8 Drawing Sheets

(56) References Cited

U.S. PATENT DOCUMENTS

| | | | | |
|---|---|---|---|---|
| 5,502,280 | A * | 3/1996 | Rocci | H01R 4/70 174/84 R |
| 5,803,770 | A | 9/1998 | Swendson et al. | |
| 6,305,962 | B1 * | 10/2001 | Maher | H01R 13/585 439/27 |
| 6,582,248 | B2 * | 6/2003 | Bachman | H01R 13/516 439/447 |
| 6,604,400 | B1 | 8/2003 | Gretz | |
| 8,651,889 | B2 * | 2/2014 | Krech | H01R 13/516 439/367 |
| 8,772,637 | B2 * | 7/2014 | Wu | H02G 15/115 174/84 R |
| 2004/0038580 | A1 | 2/2004 | Clement | |
| 2006/0035509 | A1 * | 2/2006 | O'Connor | H01R 13/5208 439/369 |
| 2010/0261367 | A1 * | 10/2010 | Billman | H01R 13/65802 439/271 |
| 2013/0337670 | A1 * | 12/2013 | Montena | H01R 13/5213 439/149 |
| 2015/0099404 | A1 * | 4/2015 | Iida | H01R 13/506 439/752 |
| 2015/0364885 | A1 * | 12/2015 | Garvey | H01R 31/06 439/367 |
| 2016/0013579 | A1 * | 1/2016 | Nooner | H01R 13/516 439/278 |
| 2016/0204547 | A1 * | 7/2016 | Iida | H01R 13/6271 439/682 |

* cited by examiner

CONNECTOR

RELATED APPLICATIONS

This application claims priority to International Application No. PCT/M2014/002921, filed Aug. 27, 2014, which claims priority to Japanese Application No. 2013-176360, filed Aug. 28, 2013, both of which are incorporated herein by reference in their entirety.

FIELD OF THE INVENTION

The present invention relates to a connector and, more specifically, to the shape of the case.

DESCRIPTION OF RELATED ART

A technique is known in which a plurality of connectors are passed successively into a cylindrical member.

BRIEF SUMMARY

However, the prior art is difficult to adapt to the increasingly smaller diameters of cylindrical members. In other words, because a bundle of cables is present in a first connector on the inside of the cylindrical member after the connector has been passed through, reducing the diameter of the cylindrical member makes it difficult to maintain enough space to allow a second connector to pass through.

In light of this problem, it is an object of the present invention to provide a connector whose case can easily pass through a cylindrical member while accommodating passed through cables.

In order to solve this problem, the present invention provides a connector including a case accommodating a passed-through cable and itself passed through a cylindrical member, a side surface of the case when aligned axially with the direction of insertion into the cylindrical member having an outer peripheral surface portion with a shape corresponding to the inner peripheral surface of the cylindrical member, and an engaging surface portion having an engaging piece for engaging another connector and forming a space for arranging the cable between the engaging surface and the inner peripheral surface of the cylindrical member.

In one aspect of the present invention, the outer peripheral surface portion corresponds to at least half the circumference of the inner peripheral surface of the cylindrical member.

In another aspect of the present invention, the case includes a main body and a cover mounted on the leading end portion of the main body in the direction of insertion, and a pair of engaging pieces for engaging the main body and the cover to each other are provided on the engaging surface portion.

In another aspect of the present invention, a groove is formed in the engaging surface portion of the cover, the groove being connected to a hole in the engaging piece provided on the cover and opening in the direction of insertion.

In another aspect of the present invention, the case includes a main body, and a retainer inserted into an opening formed in the outer peripheral surface portion of the main body and engaging terminals inserted into the main body.

The present invention is able to provide a connector whose case can easily pass through a cylindrical member while accommodating passed through cables because the side surface of the case includes an outer peripheral surface portion and an engaging surface portion.

DETAILED DESCRIPTION

The following is an explanation of an embodiment of the present invention with reference to the drawings.

Figure 1:
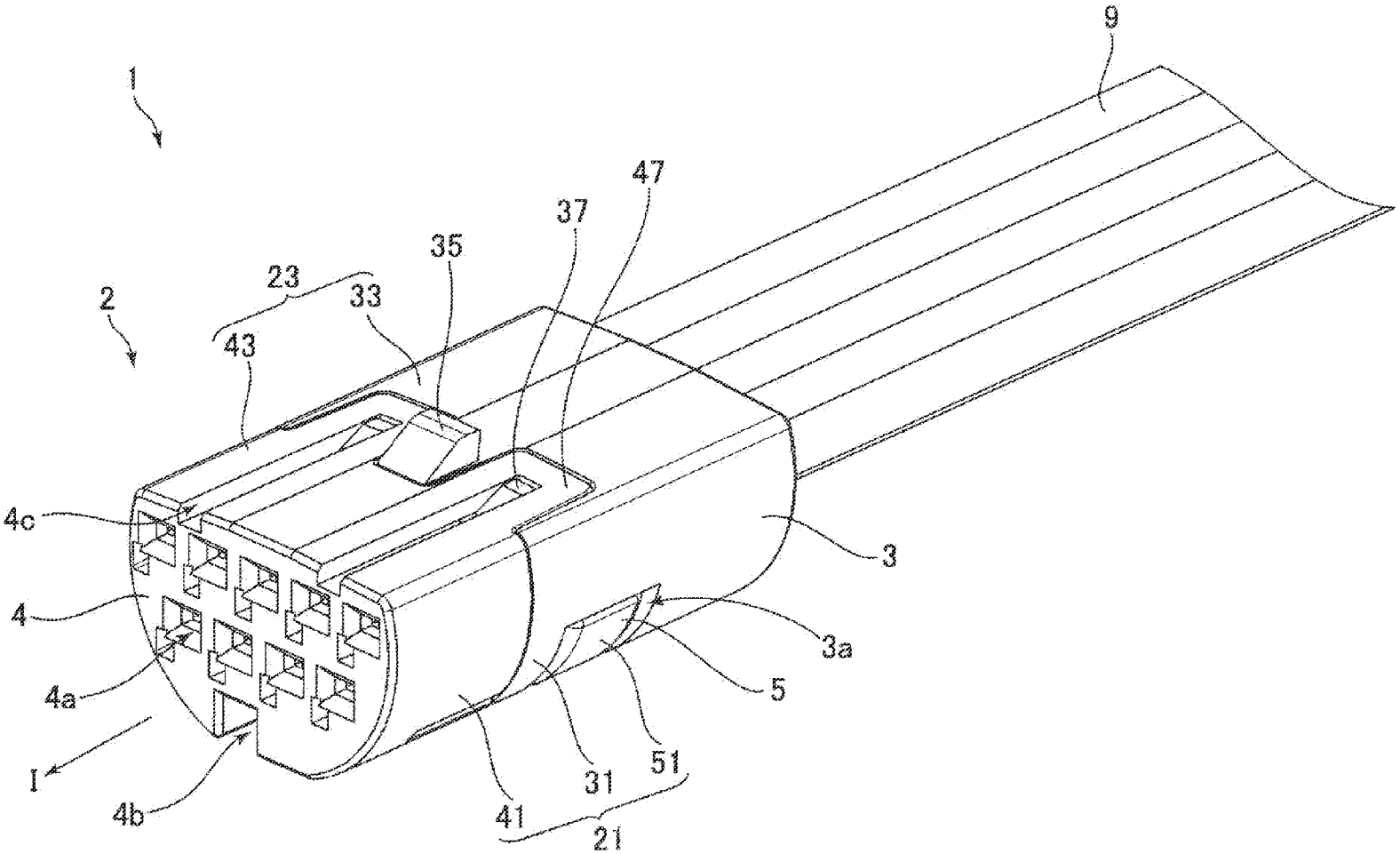
FIG. 1 is a perspective view of the connector in an embodiment of the present invention.
Figure 2:
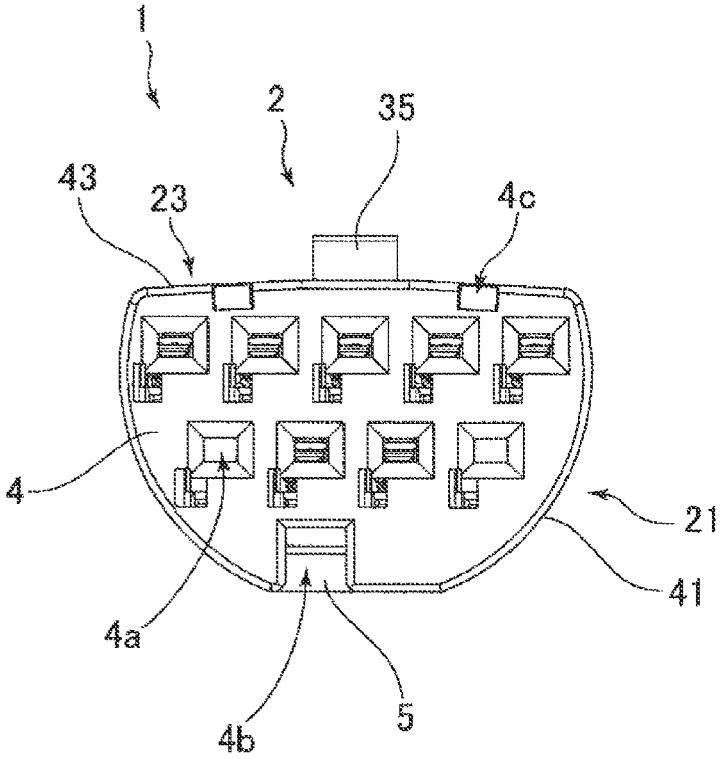
FIG. 2 is a front view of the connector.
Figure 3:
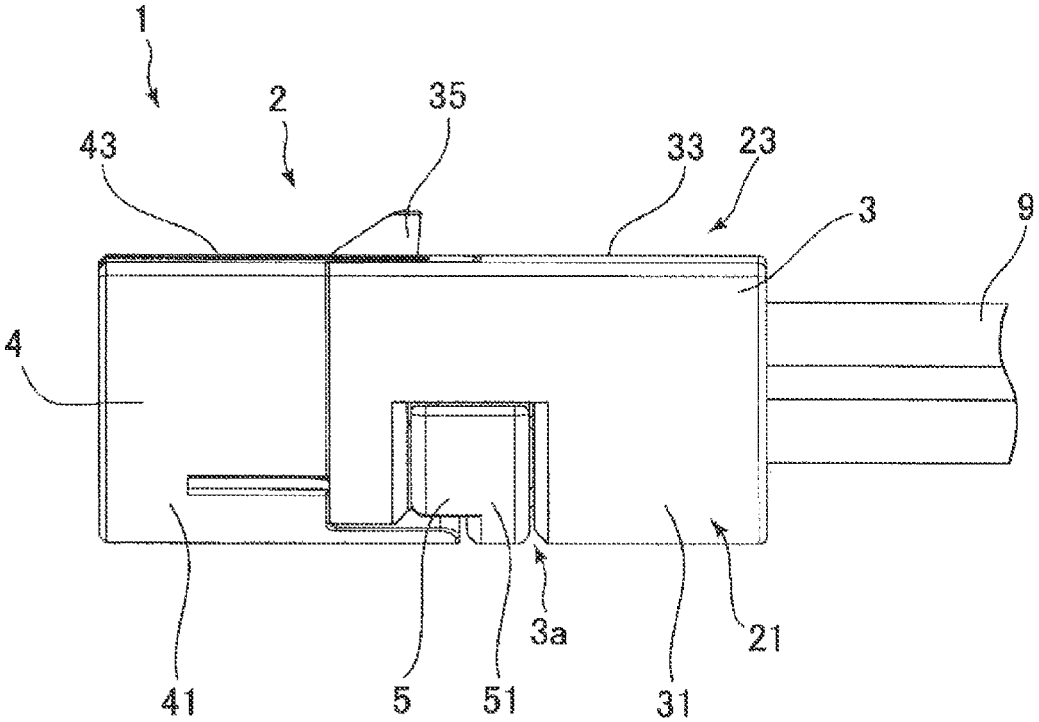
FIG. 3 is a side view of the connector.
Figure 4:
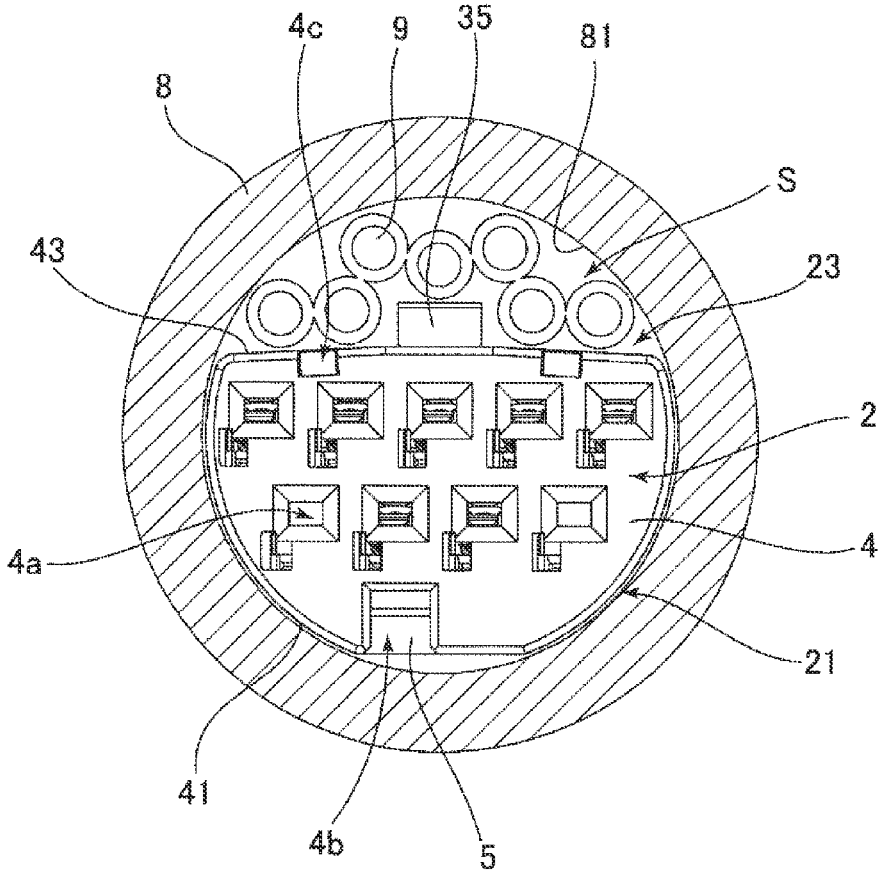
FIG. 4 is a front view of the connector inserted into the cylindrical member.

FIG. 1 through FIG. 3 are a perspective view, front view and side view, respectively, of the connector 1 in an embodiment of the present invention. FIG. 4 is a front view of the connector 1 inserted into the cylindrical member 8. In FIG. 1, arrow I indicates the direction of insertion for the connector 1. In the following explanation, the direction of insertion I is the forward direction, and the opposite direction is the rear direction.

The connector 1 has a case 2 made of a resin material which is arranged at the leading end portion of the cables 9. The terminals accommodated inside the case 2 are not shown in the drawings. The cables 9 are connected to the terminals accommodated by the case 2 and extend outward from the rear of the case 2.

The case 2 has a semicircular column shape whose longitudinal direction is its axial direction, and the side surface of the case 2 includes a rounded outer peripheral surface portion 21 and an engaging surface portion 23 which is flatter than the outer peripheral surface portion 21.

The case 2 includes a main body 3 for holding the terminals, a cover 4 attached to the front end portion of the main body 3, and a retainer 5 engaging the terminals accommodated in the main body 3.

The outer peripheral surface portion 21 of the case 2 includes the outer peripheral surface portion 31 of the main body 3, the outer peripheral surface portion 41 of the cover 4, and the outer peripheral surface portion 51 of the retainer 5. The engaging surface portion 23 of the case 2 includes the engaging surface portion 35 of the main body 3, and the engaging surface portion 45 of the cover 4.

A rectangular opening 3*a* that widens in the circumferential direction is formed in the outer peripheral surface portion 31 of the main body 3, and the retainer 5 is inserted into the main body 3 via the opening 3*a* to engage the terminals.

A tab-like engaging piece 35 is provided in the engaging surface portion 33 of the main body 3 to engage another connector 7. The engaging piece 35 protrudes orthogonally from the engaging surface portion 33 in the central portion of the engaging surface portion 33 in the traverse direction, and has a tapered surface in front. The engaging piece 35 [sic] is also provided on the front end portion of the engaging surface portion 35.

A tab-like engaging piece 37 is also provided in the engaging surface portion 33 of the main body 3 to engage the main body 3 and the cover 4 with each other. An engaging piece 37 is provided in the front end portion of the engaging surface portion 33 on both sides in the traverse direction to clamp the engaging piece 35.

Figure 8:
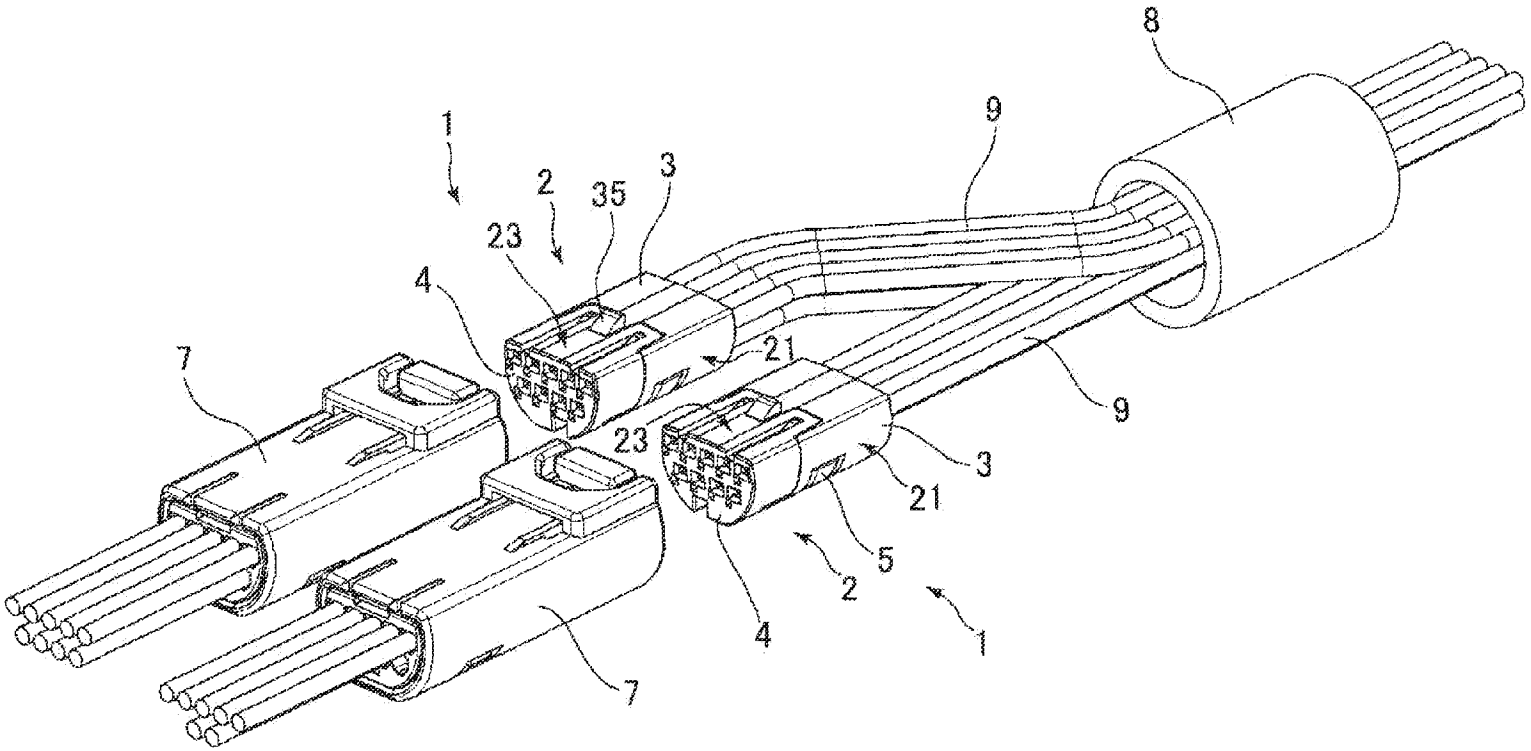
FIG. 8 is a diagram that is a continuation of FIG. 7.

A plurality of holes 4*a* is formed in the cover 4 for insertion of the terminals on another connector 7 (see FIG. 8). A groove 4*b* distinguishing the orientation and type of connector 1 is formed in the cover 4 some distance from the center in the traverse direction.

A U-shaped engaging piece 47 is provided in the engaging surface portion 43 of the cover 4 to engage the main body 3 and the cover 4 with each other. An engaging piece 47 is provided on both sides of the engaging surface portion 43 in the traverse direction corresponding to the engaging pieces 37 of the main body 3. The engaging pieces 47 extend to the rear from the rear end portion of the engaging surface portion 43.

A groove 4*c* extending in the longitudinal direction is formed in the engaging surface portion 43 of the cover 4 to connect to the holes 47 in the U-shaped engaging pieces 47, and this groove 4*c* opens in the forward direction.

As shown in FIG. 4, the outer peripheral surface portion 21 of the case 2 has a curved shape corresponding to that of the inner peripheral surface portion 81 of the cylindrical member 8. The curvature of the outer peripheral surface portion 21 of the case 2 is the same or nearly the same as that of the inner peripheral surface portion 81 of the cylindrical member 8. When the case 2 is inserted into the cylindrical member 8, the outer peripheral surface portion 21 of the case 2 comes into contact or nearly comes into contact with the inner peripheral surface 81 of the cylindrical member 8 along its entire length.

The engaging surface portion 23 of the case 2 is flat. The engaging surface portion 23 may incline somewhat towards both ends from a peak in the center portion. Because the engaging surface portion 23 of the case 2 is flat or has a curvature that is much smaller than that of the inner peripheral surface 81 of the cylindrical member 8, a space S with a semicircular profile is defined between the engaging surface portion 23 of the case 2 and the inner peripheral surface 81 of the cylindrical member 8 when the case 2 is inserted into the cylindrical member 8. A plurality of cables 9 are arranged inside the space S.

In addition, the outer peripheral surface portion 21 of the case 2 corresponds to at least half the circumference of the inner peripheral surface 81 of the cylindrical member 8. In other words, when the case 2 is inserted into the cylindrical member 8, the outer peripheral surface portion 21 of the case 2 comes into contact or nearly comes into contact with at least half the circumference of the inner peripheral surface 81 of the cylindrical member 8. Also, when the case 2 is inserted into the cylindrical member 8, the engaging surface portion 23 of the case 2 is arranged on the space S side of the central axis of the cylindrical member 8. In other words, the case 2 takes up at least half of the interior space of the cylindrical member 8.

FIG. 5 through FIG. 8 are perspective views showing the operations performed to pass two connectors 1 through the cylindrical member 8. In the example shown in these drawing, the two connectors 1 have the same shape with the exception of the position of the grooves 4*b*. Otherwise, the second connector 1 passed into the cylindrical member 8 has the same shape as the connector shown in FIG. 1 through FIG. 4.

Figure 5:
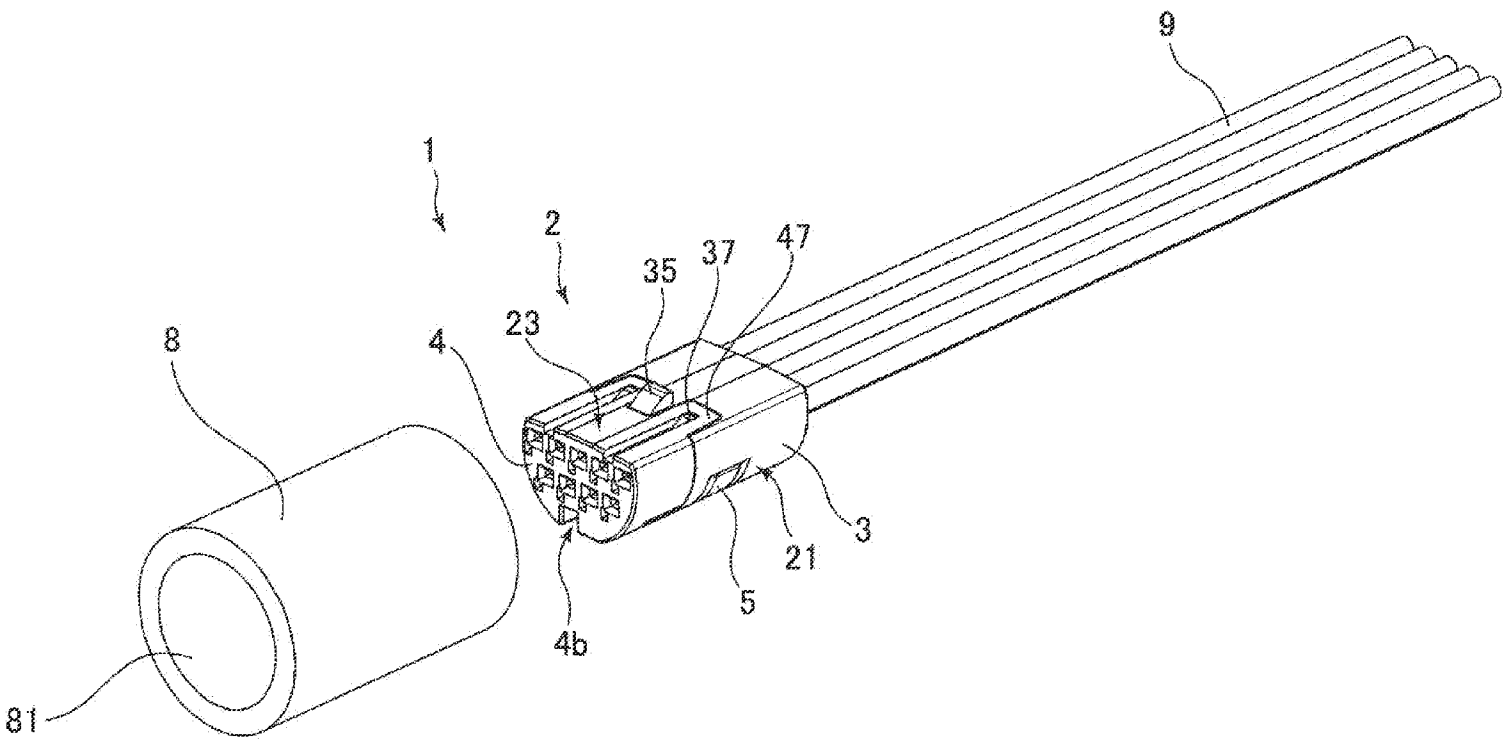
FIG. 5 is a perspective view of two connectors being passed into the cylindrical member.
Figure 6:
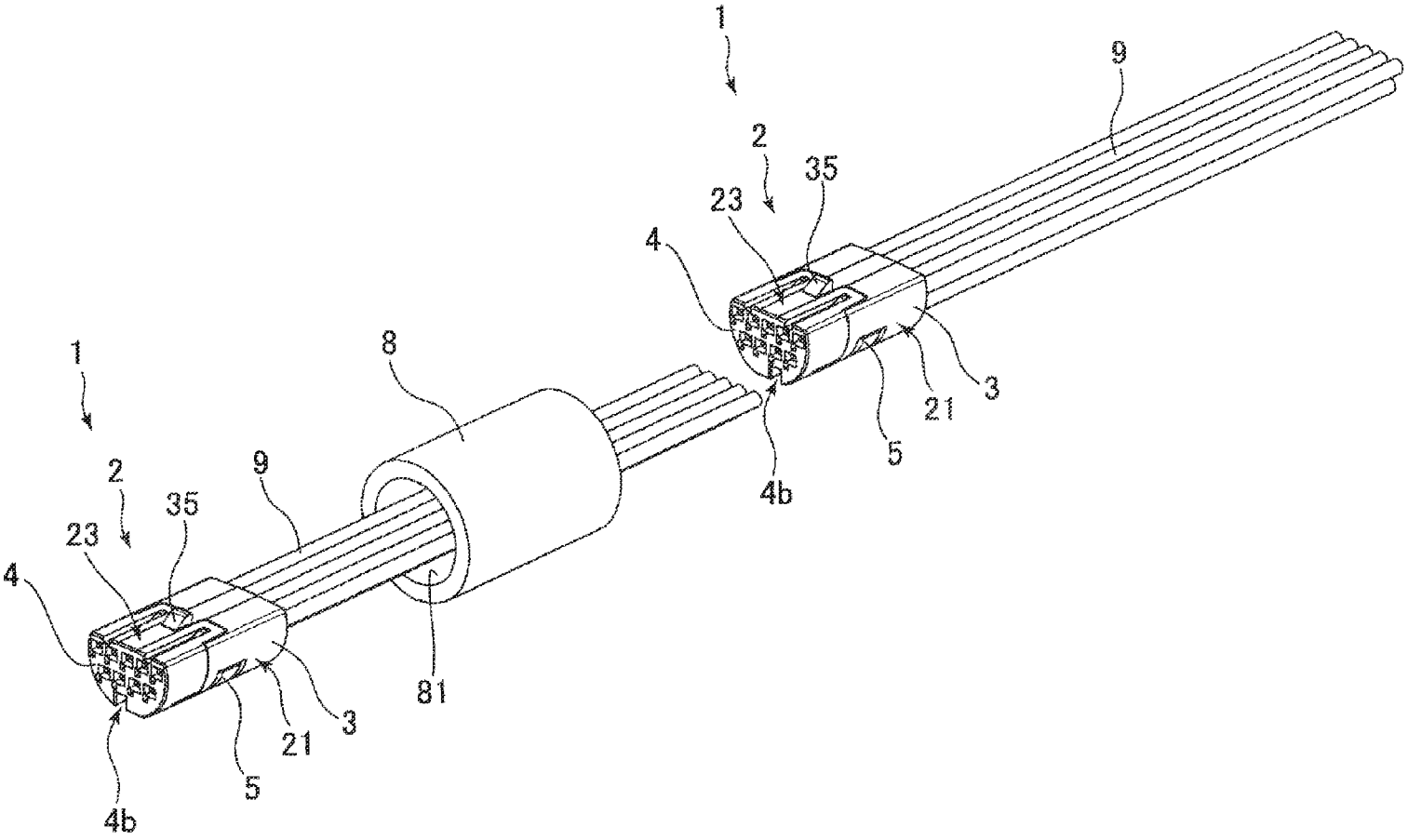
FIG. 6 is a diagram that is a continuation of FIG. 5.

First, as shown in FIG. 5 and FIG. 6, the first connector 1 is passed into the cylindrical member 8. Afterwards, the plurality of cables 9 connected to the first connector 1 are present inside the cylindrical member 8.

Figure 7:
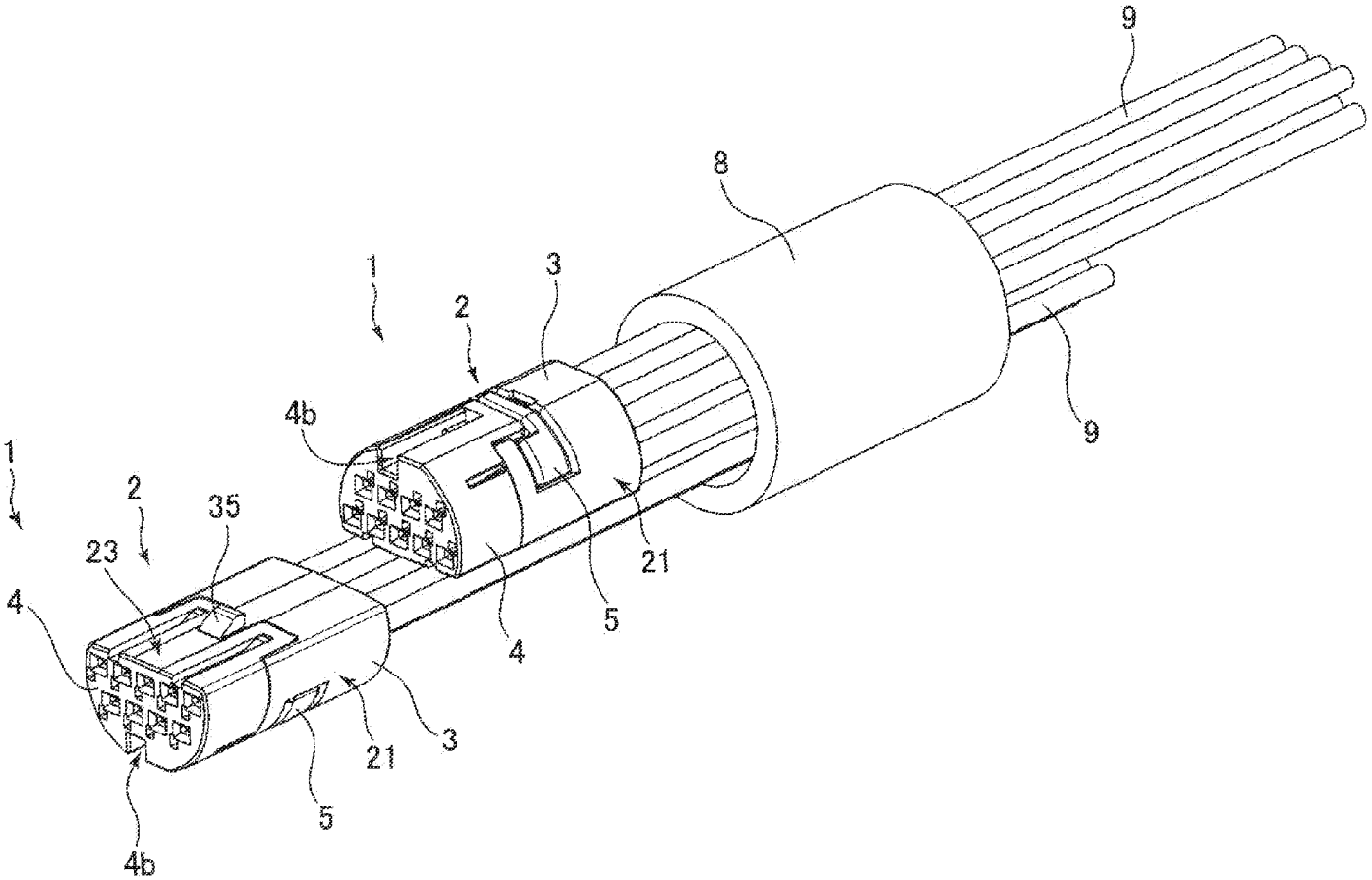
FIG. 7 is a diagram that is a continuation of FIG. 6.

Next, as shown in FIG. 6 and FIG. 7, the second connector 1 is passed into the cylindrical member 8. Because the cables 9 connected to the first connector 1 are present inside the cylindrical member 8 at this time, as shown in FIG. 4, the second connector 1 is passed into the cylindrical member 8 while the outer peripheral surface portion 21 of the case 2 comes into contact with, or nearly comes into contact, with the inner peripheral surface 81 of the cylindrical member 8, and while the cables 9 are arranged in the space S formed by the engaging surface portion 23 of the case 2 and the inner peripheral surface 81 of the cylindrical member 8.

Finally, as shown in FIG. 8, the two connectors 1 are mated with another connector 7. In this way, the number of poles can be increased by passing two connectors 1 through the cylindrical member 8.

In the embodiment explained above, the engagement surface portion 23 of the case 2 was flat, an engaging piece 35 was provided, and the outer peripheral surface 21 of the case 2 had a shape corresponding to that of the inner peripheral surface 81 of the cylindrical member 8. Therefore, when the case 2 is inserted into the cylindrical member 8, the outer peripheral surface portion 21 of the case 2 comes into contact with, or nearly comes into contact with, the inner peripheral surface portion 81 of the cylindrical member 8, and the cross-sectional area of the space S in which the cables 9 are arranged can be maintained.

In the present embodiment, the outer peripheral surface portion 21 of the case 2 corresponds to at least half the circumference of the inner peripheral surface 81 of the cylindrical member 8. Because parallel movement of the cases 2 inside the cylindrical member 8 is inhibited in the direction orthogonal to the axial direction, the space S in which the cables 9 are arranged can be safely maintained.

In the present embodiment, the groove 4*c* is formed in the engaging surface portion 23 of the case 2 so as to open in the forward direction. This can be expected to guide the cables 9 into the space S between the outer peripheral surface portion 21 of the case 2 and the inner peripheral surface 81 of the cylindrical member 8. The groove 4*c* may also widen in the forward direction.

An embodiment of the present invention was described above, but the present invention is not limited to this embodiment in any way. It should be clear to a person skilled in the art that many other modifications are possible within the spirit and scope of the present invention.

Figure 9:
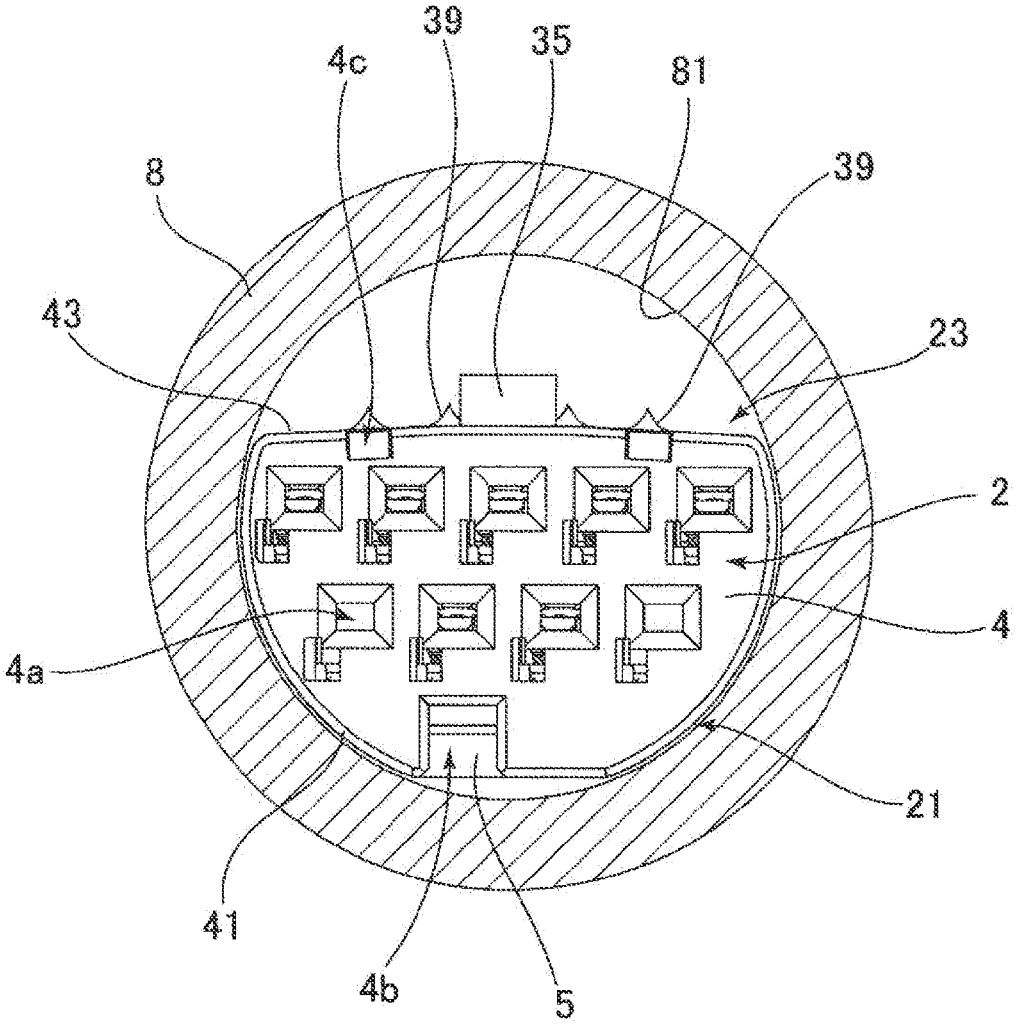
FIG. 9 is a front view of the connector in another embodiment of the present invention.

For example, as shown in FIG. 9, a plurality of ridge portions 39 may be provided in the engaging surface portion 23 of the case 2 so as to extend in the longitudinal direction. This can be expected to guide the cables 9 into the space S. The interval between two ridge portions 39 may widen in the forward direction.

The invention claimed is:

1. A connector comprising:

a case, a cable accommodated in the case, the case configured to pass through a cylindrical member along an insertion direction, the cylindrical member having an inner peripheral surface, a side surface formed on the case, the side surface of the case having an outer peripheral surface portion with a shape corresponding to the inner peripheral surface of the cylindrical member when aligned along the insertion direction, and an engaging surface portion having an engaging piece for engaging another connector and wherein the engaging surface portion defines a space for arranging the cable between the engaging surface portion and the inner peripheral surface of the cylindrical member.

2. The connector according to claim 1, wherein the outer peripheral surface portion corresponds to at least half the circumference of the inner peripheral surface of the cylindrical member.

3. The connector according to claim 1, wherein the case comprises a main body and a cover, the cover mounted on a leading end portion of the main body in the direction of insertion, the cover includes an engaging surface portion and a pair of engaging pieces provided on the engaging surface portion of the cover for engaging the main body.

4. The connector according to claim 3, wherein a groove is formed in the engaging surface portion of the cover, the groove being connected to a hole in the engaging piece provided on the cover in the direction of insertion.

5. The connector according to claim 1, wherein the case comprises a main body, a terminal inserted into the main body, a retainer inserted into an opening formed in the outer peripheral surface portion and the retainer engaging the terminal.

* * * * *